US007419219B2

(12) United States Patent
Grove

(10) Patent No.: US 7,419,219 B2
(45) Date of Patent: Sep. 2, 2008

(54) ADJUSTABLE ARM ASSEMBLY FOR A CHAIR

(76) Inventor: James E. Grove, 4316 Marina City Dr., 423 CTN, Marina Del Rey, CA (US) 90292

( * ) Notice: Subject to any disclaimer, the term of this patent is extended or adjusted under 35 U.S.C. 154(b) by 0 days.

(21) Appl. No.: 11/529,503

(22) Filed: Sep. 29, 2006

(65) Prior Publication Data

US 2008/0079302 A1 Apr. 3, 2008

(51) Int. Cl.
*A47C 7/54* (2006.01)

(52) U.S. Cl. ..... 297/411.36

(58) Field of Classification Search ..... 297/411.36, 297/411.2, 411.35; 248/118.3
See application file for complete search history.

(56) References Cited

U.S. PATENT DOCUMENTS 6,336,680 B1 * 1/2002 Lee ..... 297/411.36
6,398,309 B1 * 6/2002 Chen ..... 297/411.36
6,419,323 B1 * 7/2002 Chu et al. ..... 297/411.36
6,957,867 B1 * 10/2005 Su ..... 297/411.36
2005/0146191 A1 * 7/2005 Machael et al. ..... 297/411.36
* cited by examiner

*Primary Examiner*—Milton Nelson, Jr.
(74) *Attorney, Agent, or Firm*—Morland C. Fischer

(57) ABSTRACT

An adjustable arm assembly for a chair is described including an adjustable arm having a detent actuator to be manually depressed so that elevation of the chair arm can be selectively adjusted relative to the chair seat to accommodate the arms of a user. An elevation adjustment tube to which the adjustable arm is connected is slidable through a hollow elevation guide tube at the side of the chair so that the elevation of the adjustable arm can be changed. A lock is carried by and slidable with the elevation adjustment tube through the elevation guide tube. The lock has a detent pin that is moved into receipt by one of a plurality of detent holes formed in the elevation guide tube when the detent actuator is not being operated so as to releasably retain the elevation adjustment tube within the elevation guide tube. An elongated actuator arm runs through the elevation adjustment tube between the detent actuator and the lock. A pressing force manually applied to the detent actuator causes the actuator arm to move longitudinally through the elevation adjustment tube towards the lock. Accordingly, the detent pin of the lock is pulled out of its receipt by the detent hole formed in the elevation guide tube, whereby to permit the elevation adjustment tube to slide through the elevation guide tube so that the elevation of the adjustable arm can be changed.

17 Claims, 5 Drawing Sheets

ADJUSTABLE ARM ASSEMBLY FOR A CHAIR

BACKGROUND OF THE INVENTION

1. Field of the Invention

This invention relates to an adjustable arm assembly for a chair including an adjustable chair arm having a detent actuator to be manually depressed so that the elevation of the chair arm can be selectively adjusted relative to the chair seat to suit the needs and comfort of one who is seated on the chair.

2. Background Art

Whether it be a home or office chair, the opposing arms that are commonly associated with such chairs are typically fixed in place. That is to say, the chair arms are connected to opposite sides of the seat and/or to the back rest of the chair so that the elevation of the arms relative to the seat is not adjustable. In cases where one seated on the chair is very tall or a small child, it may be desirable to have the ability to adjust the position of the arms of the chair in order to better accommodate the arm of the occupant. In other words, by being able to raise or lower the chair arms, the comfort of one seated on the chair could be advantageously enhanced, regardless of his height. Therefore, it would be desirable to have access to a chair having arms that may be quickly, easily and selectively adjusted between a range of elevations to meet the needs of the user.

SUMMARY OF THE INVENTION

Briefly, and in general terms, an adjustable arm assembly is disclosed for a home or an office chair of the kind having a seat and a back rest. The arm assembly includes an adjustable arm located adjacent one side of the seat. A detent actuator is manually accessible at the adjustable arm to receive a pushing force thereagainst to enable the elevation of the arm relative to the seat to be selectively adjusted to meet the needs and enhance the comfort of one who is seated on the chair.

Depending from the adjustable chair arm is a hollow elevation adjustment tube. A cylindrical lock housing is carried at the bottom of the elevation adjustment tube. When the detent actuator is depressed by the user, the elevation adjustment tube and the lock housing carried thereby are slidable reciprocally through a hollow inner guide tube of the arm assembly to correspondingly adjust the elevation of the chair arm. The inner guide tube is surrounded by and coaxially aligned with an outer arm tube cover. Structural frame tubes are received through the outer arm tube cover for connection to the inner guide tube by which to hold the adjustable arm assembly alongside the chair.

An elevation adjustment slot is formed at one side of the inner guide tube, and a set of axially aligned detent holes is formed along the opposite side. An elevation adjustment stop is sized to be received in and ride through the elevation adjustment slot. A key projects from the elevation adjustment stop. In the assembled configuration, with the elevation adjustment tube of the adjustable arm located inwardly of the inner guide tube, the elevation adjustment stop is connected to the lock housing carried by the elevation adjustment tube such that the key of the stop is mated to a keyhole formed in the lock housing. As the lock housing slides up and down through the inner guide tube with the elevation adjustment tube after the detent actuator is first depressed, the elevation adjustment stop connected to the lock housing correspondingly rides through the elevation adjustment slot so as to limit the movement of the adjustable arm depending upon the dimensions of the adjustment slot.

A lock is carried by and movable laterally through the lock housing. When the adjustable arm is at rest and no pushing force is applied to the detent actuator thereof, a detent pin of the lock is urged into receipt by one of the set of detent holes formed in the inner tube guide. When it is desirable to change the elevation of the adjustment arm, a pushing force is applied to the detent actuator. The pushing force is transferred from the detent actuator to a spring biased actuator arm which runs through the hollow elevation adjustment tube to the lock within the lock housing. A ramped fork located at one end of the actuator arm is seated upon the detent pin of the lock. An axial movement of the actuator arm through the elevation adjustment tube in response to a pushing force applied to the detent actuator is translated into a lateral displacement of the lock through the lock housing to cause the detent pin thereof to move outwardly of its detent hole. The elevation adjustment tube is now pushed downwardly or pulled upwardly through the inner guide tube to change the elevation of the adjustable arm. When the pushing force is removed from the detent actuator, the detent pin of the lock is automatically driven through a different one of the detent holes in the inner guide tube by which to retain the new position of the adjustable arm as selected by the user.

DESCRIPTION OF THE PREFERRED EMBODIMENT

Figure 2:
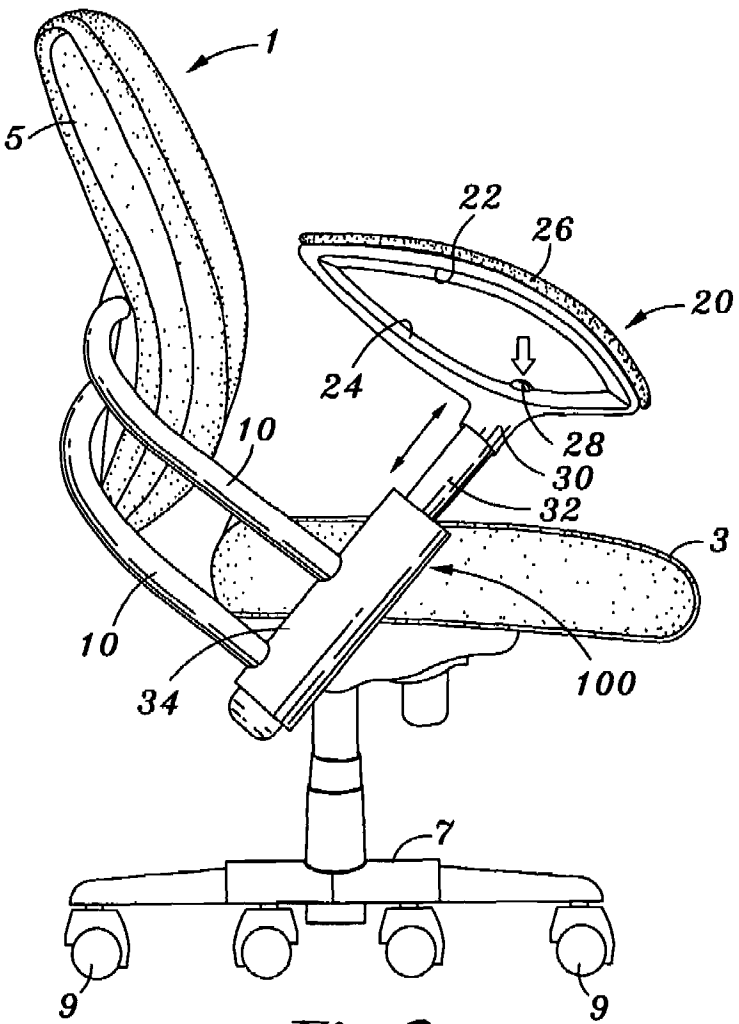
FIG. 2 is a side view of the chair of FIG. 1 showing one of the adjustable arm assemblies.
Figure 1:
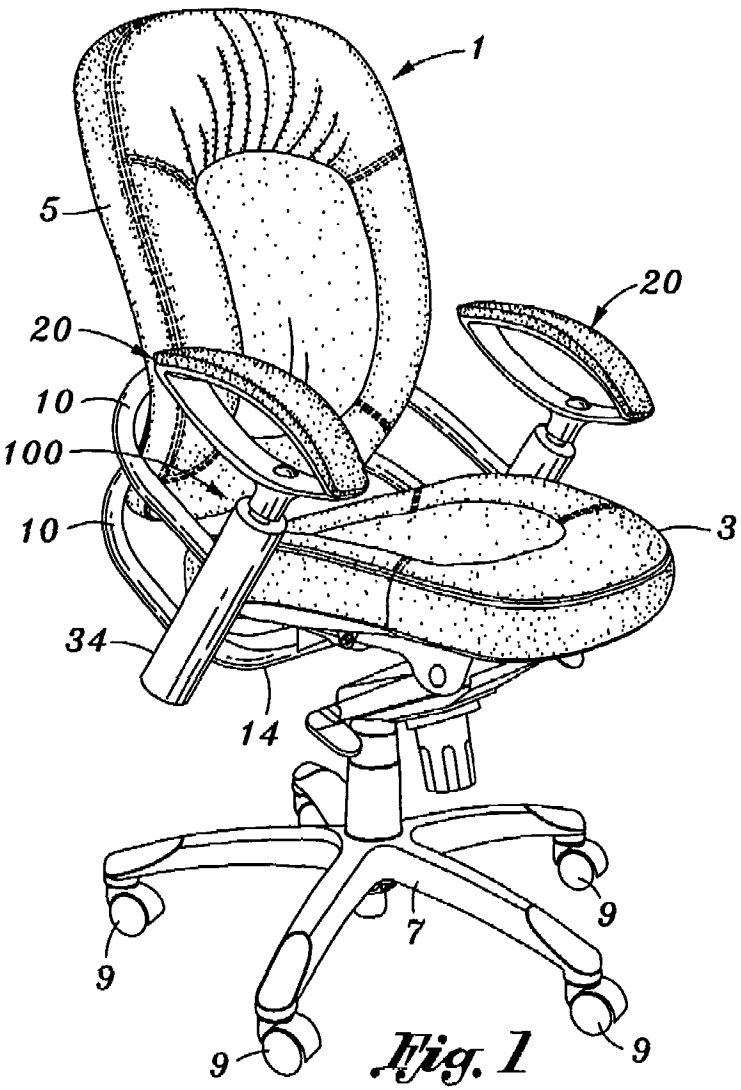
FIG. 1 is a perspective view of a chair having a pair of adjustable arm assemblies according to a preferred embodiment of this invention located at opposite sides of the chair.
Figure 3:
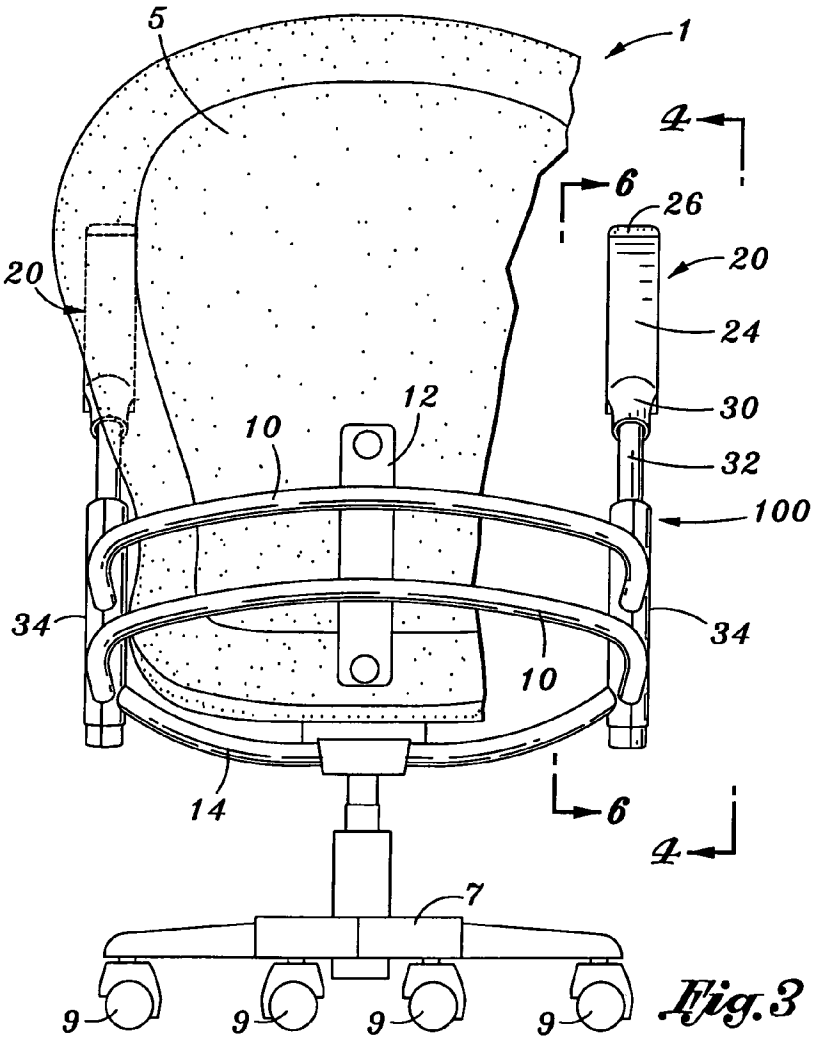
FIG. 3 is a rear view of the chair of FIG. 1.

Referring initially to FIGS. 1-3 of the drawings, there is shown a home or office chair 1 including an adjustable arm assembly 100 having an adjustable arm 20 which forms the present invention. The chair 1 that is illustrated in the drawings is for purposes of example only and is not intended to limit the present improvement. The chair 1 has the usual seat 3 and back rest 5 that are supported by a base 7 having rollers (e.g., castors) 9 to permit the chair to roll over a flat surface.

In the present example, a pair of frame tubes 10 bend around the back rest 5 of chair 1 to hold the adjustable arms 20 at opposite sides of the seat 3 at which to accommodate the arms of a user. The frame tubes 10 are connected to the back of seat 3 at a mounting bracket or plate 12 (of FIG. 3). An undercarriage support tube 14 (also of FIG. 3) runs underneath the seat 3 between the arms 20 adjacent the sides of chair 1 by which to connect the seat 3 and back rest 5 to the base 7.

According to a preferred embodiment, and for the purpose of aesthetics, each of the adjustable arms 20 of the arm assemblies 100 at opposite sides of the seat 3 of chair 1 includes an upper arm member 22 and a lower arm member 24 spaced therefrom. However, the adjustable arm 20 of the adjustable arm assembly 100 may also include a single arm member as opposed to the upper and lower arm members 22 and 24, as shown. In the preferred embodiment, the upper arm member 22 is covered by a pad 26 or similar cushion material against which one of the arms of the user will rest when the user is seated in the chair 1.

A detent actuator 28 is manually accessible to the user at the lower arm member 24. As will be described in greater detail hereinafter, a pushing force applied to the detent actuator 28 in the direction of the reference arrow of FIG. 2 allows the user to selectively change the elevation of each adjustable arm 20 relative to the seat 3 of the chair 1 so that the comfort and convenience of the user seated in the chair will be maximized when the user lays one of his arms against the pad 26 on the upper arm member 22. In this same regard, it may be appreciated that the lower arm member 24 can be grasped and the detent actuator 28 depressed so that the elevation of the adjustable arm 20 can be changed by using only a single hand rather than both hands as is often required with conventional adjustable chair arms.

Depending downwardly from the lower arm member 26 of the adjustable arm 20 is a sleeve 30. The top of a hollow elevation adjustment tube 32 is fixedly received within the sleeve 30. The bottom of the elevation adjustment tube 32 is slidably received within an outer arm tube cover 34 of the adjustable arm assembly 100. The frame tubes 10 which bend around and are connected to the back rest 5 of chair 1 extend through the outer arm tube covers 34 so that the adjustable arms 20 are positioned adjacent the seat 3 at opposites sides of the chair 1. When the detent actuator 28 is depressed, the elevation adjustment tube 32 is capable of reciprocal movement into and out of the outer arm tube cover 34 in response to a pushing force or a pulling force applied to one of the upper or lower arm members 22 and 24 so that the elevation of the adjustable arm 20 can be selectively changed to meet the needs of the user.

Figure 4:
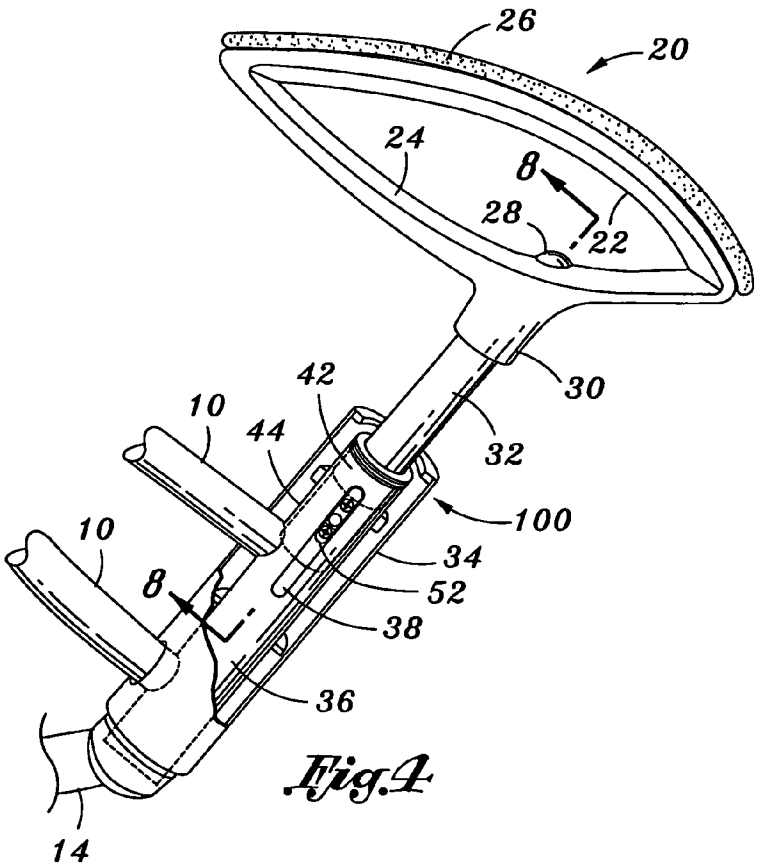
FIG. 4 is a partially broken away side view of an adjustable arm assembly at one side of the chair.
Figure 6:
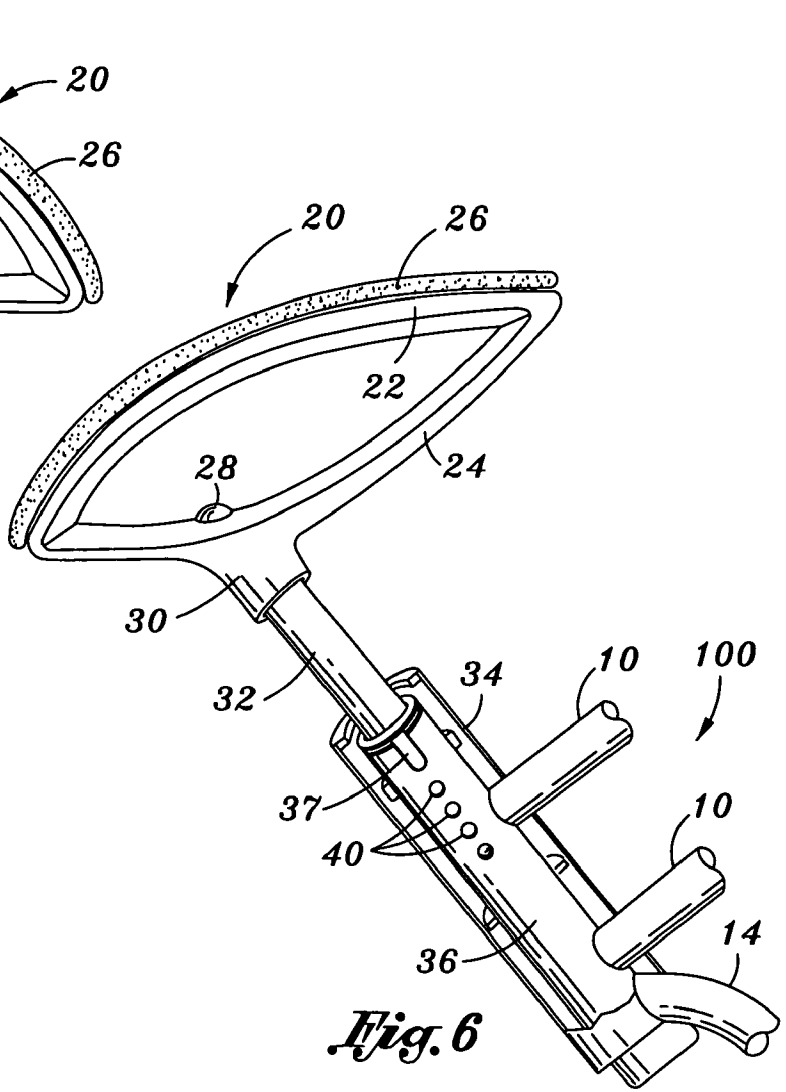
FIG. 6 shows the adjustable arm of FIG. 5 slidably received by the inner guide tube of the adjustable arm assembly.
Figure 5:
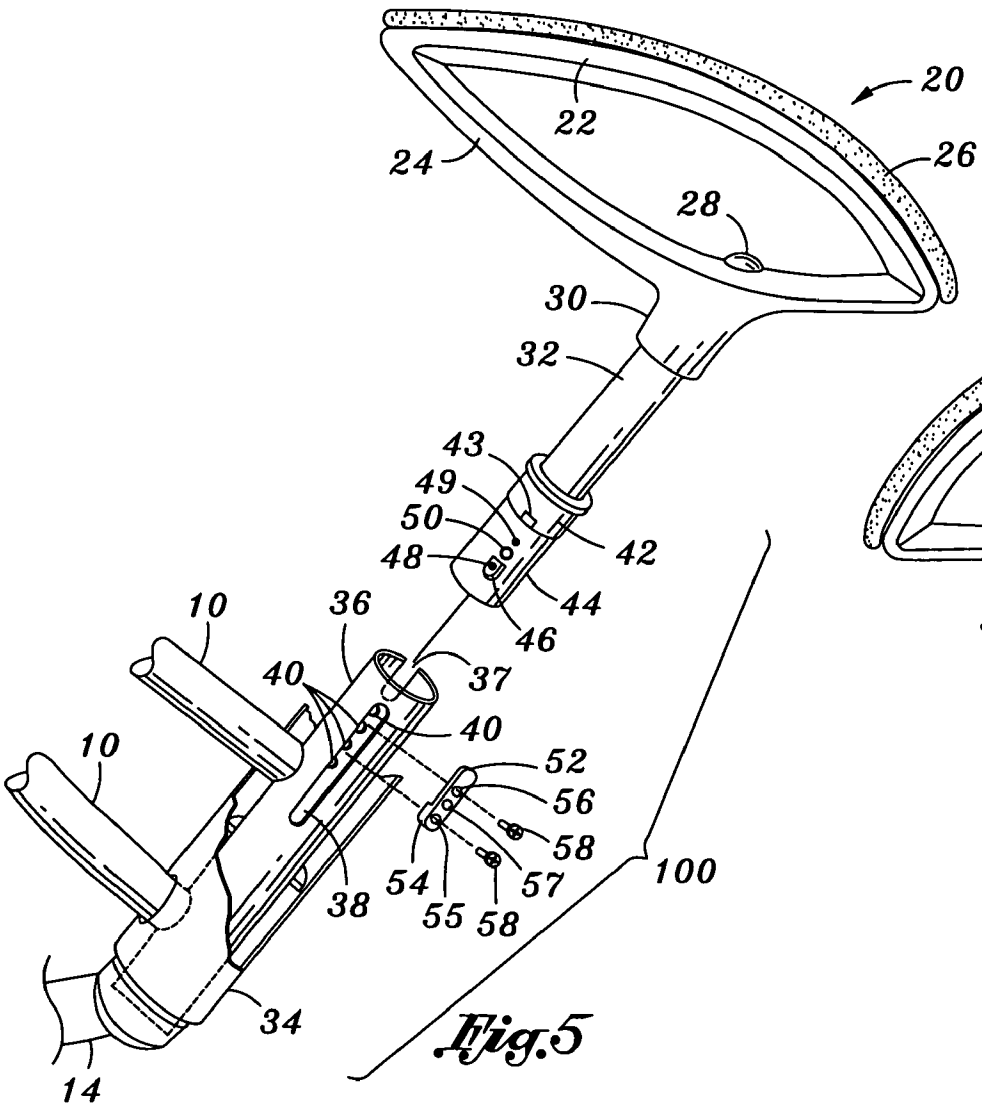
FIG. 5 is an exploded view illustrating the removable receipt of an adjustable arm by an inner guide tube of the adjustable arm assembly.

The details of the adjustable arm assembly 100 and the adjustable chair arm 20 thereof and the ability of the user to change the elevation of arm 20 relative to the seat 3 of chair 1 are now disclosed while referring to FIGS. 4-6 of the drawings. As previously indicated, the elevation adjustment tube 32 is slidably received within the outer arm tube cover 34. More particularly, each one of the adjustable arms 20 at opposite sides of the chair 1 includes an inner guide tube 36 that is surrounded by and coaxially aligned with the outer arm tube cover 34. The pair of frame tubes 10 which hold the adjustable chair arms 20 alongside the chair as well as the undercarriage support tube 14 which connects the seat 3 and back rest 5 to the base 7 extend through the outer arm tube cover 34 for connection to the inner guide tube 36.

As is best shown in FIGS. 4 and 5, an elevation adjustment slot 38 is formed in one side of the inner guide tube 36. As is best shown in FIG. 6, a series of axially aligned detent holes 40 are formed in the opposite side of the inner guide tube 36 so as to lie in opposing alignment with the elevation adjustment slot 38. The length of the elevation adjustment slot 38 determines the range over which the elevation of an adjustable arm 20 can be changed when the detent actuator 28 is depressed in a manner that will soon be described.

A retaining ring 42 is slidably received around the elevation adjustment tube 32 of adjustable arm 20. A protrusion 43 (of FIG. 5) projects outwardly from the retaining ring 42 for receipt within an axial slot 37 at the top of the inner guide tube 36 to prevent the elevation adjustment tube 32 and the adjustable arm 20 from rotating relative to the inner guide tube 36. Located below the retaining ring 42 and connected around the bottom of the elevation adjustment tube 32 is a cylindrical lock housing 44. As is best shown in FIG. 5, a keyhole 46 is formed in one side of lock housing 44. A first threaded hole 48 is located within the keyhole 46. A second threaded hole 49 is located in lock housing 44 above the first hole 48. A lock pin opening 50 extends through one side of the lock housing 44 so as to lie between the first and second threaded holes 48 and 49.

In the assembled configuration, the retaining ring 42 and the cylindrical lock housing 44 at the bottom of the elevation adjustment tube 32 are slidably received within the inner guide tube 36 surrounded by the outer arm tube cover 34 so that the protrusion 43 (of FIG. 5) will be captured by slot 37. An elevation adjustment stop 52 (also of FIG. 5) is moved through the elevation adjustment slot 38 and into mating engagement with the lock housing 44. The elevation adjustment stop 52 has a key 54 projecting therefrom. A pair of holes 55 and 56 are formed in opposite ends of the elevation adjustment stop 52, and a lock exit port 57 is formed between holes 55 and 56. The key 54 of elevation adjustment stop 52 is sized for receipt within the keyhole 46 of lock housing 44.

Figure 8:
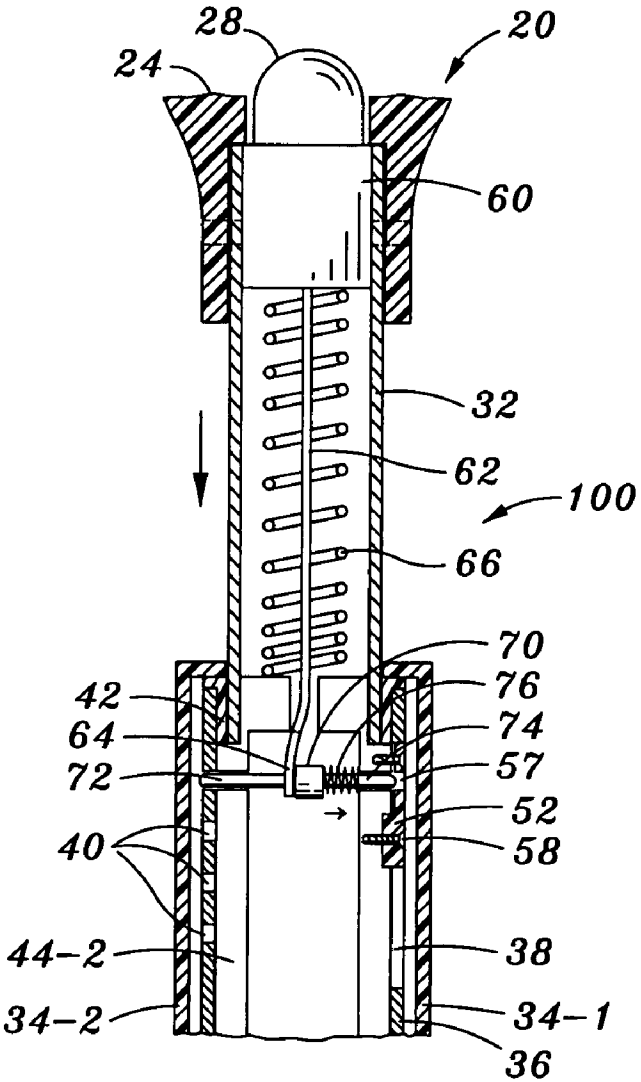
FIG. 8 is a cross-section showing the adjustable arm assembly in the assembled configuration.

A pair of threaded fasteners 58 are moved through the holes 55 and 56 in the elevation adjustment stop 52 for receipt by respective ones of the threaded holes 48 and 49 in lock housing 44 (best shown in FIG. 8). Accordingly, the elevation adjustment stop 52 will be carried by the lock housing 44 so as to ride through the elevation adjustment slot 38 of inner guide tube 36 as the elevation adjustment tube 32 and the lock housing 44 coupled thereto slide up and down through the inner guide tube 36 to change the elevation of the adjustable arm 20 following a depression of detent actuator 28.

In this regard, the elevation adjustment stop 52 controls the adjustable nature of arm 20 by limiting the reciprocal movement of the lock housing 44 through the inner guide tube 36. That is to say, the elevation adjustment stop 52 will be captured and retained against the bottom and top of the elevation adjustment slot 38 along which the elevation stop 52 travels as the adjustable chair arm 20 is subjected to a downward pushing or upward pulling force. When the elevation adjustment stop 52 contacts the bottom or top of the adjustment slot 38, any further displacement of the lock housing 44 to which the stop 52 is connected will be blocked. By virtue of the foregoing, additional movement of the elevation adjustment tube 32 downwardly or upwardly through the inner guide tube 36 is prevented, whereby to establish the lower and upper limits to which the elevation of arm 20 can be adjusted when the detent actuator 28 is depressed.

With the elevation adjustment stop 52 attached to the lock housing 44 by way of the elevation adjustment slot 38, the lock exit port 57 that is formed in stop 52 will be axially aligned with the lock pin opening 50 through lock housing 44. In this manner, and as will be disclosed when referring to FIGS. 7 and 8, a spring receiving pin (designated 74 in FIGS. 7 and 8) of a lock 70 can be urged inwardly or pushed outwardly through the axially aligned lock pin opening 50 and lock exit port 57 to enable the position of the chair arm 20 to be adjusted from one elevation to another following the depression of the detent actuator 28 and the application of a pushing or pulling force to one of the upper or lower arm members 22 and 24.

Figure 7:
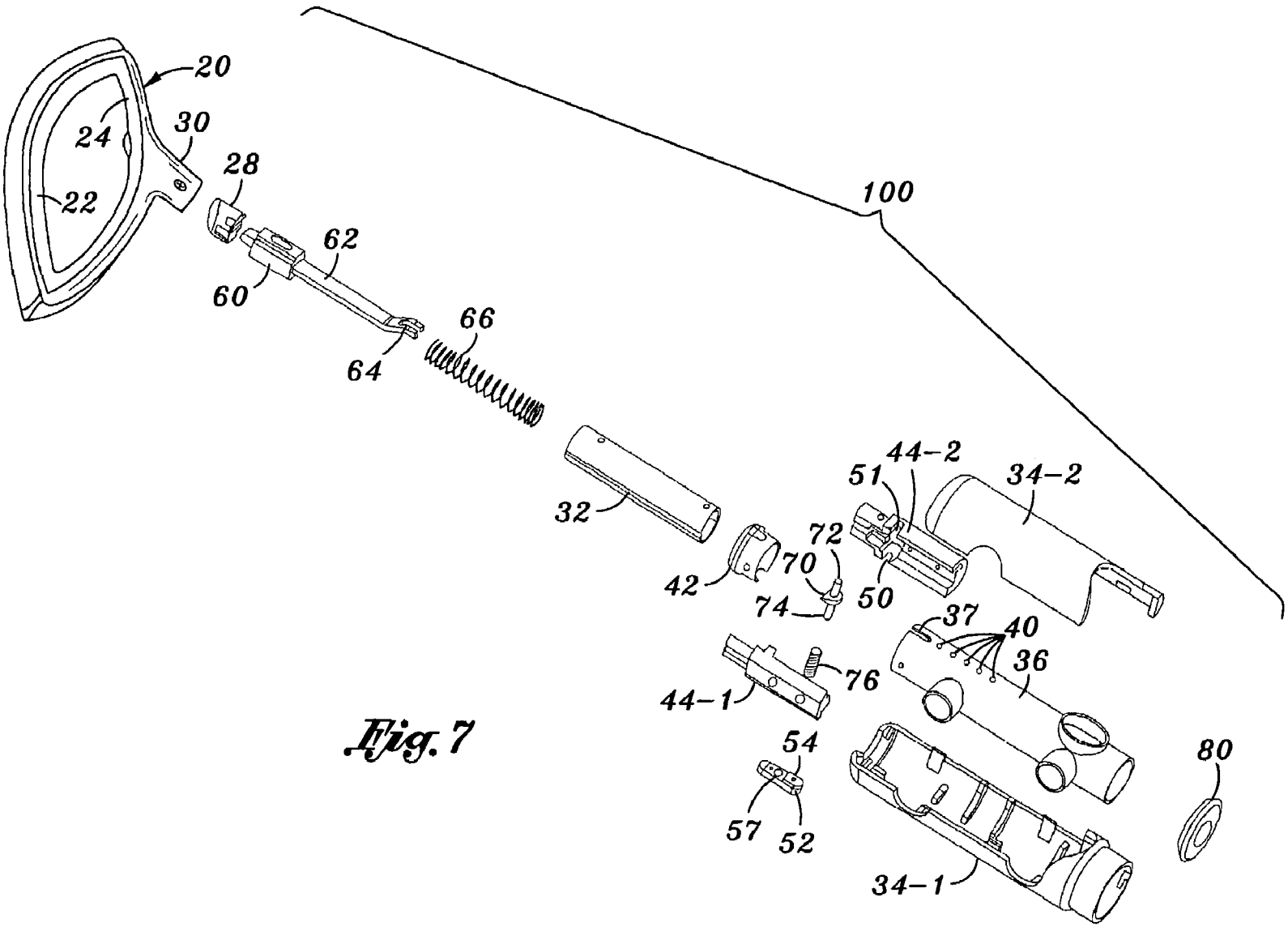
FIG. 7 is an exploded view of the adjustable arm assembly according to the preferred embodiment.

Turning now to FIGS. 7 and 8 of the drawings, further details of the adjustable arm assembly 100 and the manner in which the detent actuator 28 is depressed to cause a corresponding change in the elevation of the adjustable chair arm 20 are provided. The detent actuator 28 is connected from chair arm 20 through sleeve 30 to a relatively wide actuator head 60 at one end of an elongated actuator arm 62. As an important feature of this invention, a ramped fork 64 is located at the opposite end of actuator arm 62. A coiled compression spring 66 surrounds the actuator arm 62 between the actuator head 60 thereof and the ramped fork 64.

In the assembled configuration (of FIG. 8), the retaining ring 42 is located around the bottom of the hollow elevation adjustment tube 32 within the hollow inner guide tube 36. First and opposing sides 44-1 and 44-2 of the lock housing 44 are mated to one another around the elevation adjustment tube 32 within the inner guide tube 36 so as to lie below retaining ring 42. As previously described, the lock housing 44 surrounds the bottom of the elevation adjustment tube 32 below the retaining ring 42, such that the adjustable arm 20 is coupled to inner guide tube 36 via elevation adjustment tube 32 and lock housing 44.

A lock 70 is mounted in and slidable laterally through the lock housing 44. The lock 70 has a detent pin 72 at one end thereof and an axially aligned spring receiving pin 74 at the opposite end. In the assembled configuration of FIG. 8, the ramped fork 64 of actuator arm 62 is seated upon the detent pin 72 to control the lateral displacement of the lock 70 in response to a depression of the detent actuator 28. A coiled spring 76 surrounds the spring receiving pin 74 of lock 70. When there is no change desired to the elevation of adjustable arm 20 and the detent actuator 28 is at rest, the coiled spring 76 exerts a pushing force against the lock 70 to urge (i.e., normally bias) the detent pin 72 of lock 70 outwardly through a detent pin opening 51 (of FIG. 7) formed in one side 44-2 of the lock housing 44 for receipt by one of the detent holes 40 formed in the inner guide tube 36. The receipt of the detent pin 72 of lock 70 in a detent hole 40 locks the adjustable arm 20 at the particular elevation selected by the user after the elevation adjustment tube 32 slides through the inner guide tube 36.

When it is desirable to change the elevation of the adjustable arm 20, and as will soon be explained, a manual pushing force applied to the detent actuator 28 causes the spring 76 to be compressed so as to store energy. The detent pin 72 of lock 70 is withdrawn from its detent hole 40 in the inner guide tube 36 and pulled inwardly relative to the detent pin opening 51 formed in the side 44-2 of lock housing 44. Accordingly, the elevation adjustment tube 32 and the lock housing 44 carried thereby are now free to be pushed downwardly or pulled upwardly through the inner guide tube 36 to correspondingly change the elevation of the adjustable arm 20 to suit the needs of the user.

When the detent actuator 28 is released (at the selected elevation), spring 76 will release its stored energy and expand to cause the detent pin 72 of lock 70 to be pushed outwardly relative to the detent pin opening 51 of lock housing 44 and into a different one of the detent holes 40 in the inner guide tube 36. With the detent pin 72 of lock 70 once again received through a detent hole 40 to prevent further displacement of the elevation adjustment tube 32, the adjustable arm 20 will be held at the new elevation selected by the user until the detent actuator 28 is once again depressed.

Like the lock housing 44, a pair of sides 34-1 and 34-2 are mated to one another to establish the hollow cylindrical outer arm tube cover 34 around inner guide tube 36. The elevation adjustment stop 52 having key 54 is connected to one side 44-1 of the lock housing 44 as previously described so as to be capable of riding through the elevation adjustment slot (designated 38 in FIG. 8) of inner guide tube 36. As is best shown in FIG. 8, when the elevation adjustment stop 52 is connected to the lock housing 44 of the adjustable arm 20 by means of the threaded fasteners 58, the spring receiving pin 74 of lock 70 is aligned for receipt through the lock exit port 57 in stop 52 as the detent actuator 28 is depressed to effect a change in the elevation of adjustable arm 20.

Referring specifically to the assembled configuration of the adjustable arm assembly 100 illustrated in FIG. 8, the adjustable arm 20 is shown at rest. In this case, the coiled compression spring 66 surrounding the actuator arm 62 is relaxed. The lock 70 within lock housing 44 is positioned so that the detent pin 72 extends outwardly from the detent opening 51 (of FIG. 7) in one side 44-2 of lock housing 44 for receipt through one of the detent holes 40 formed in the hollow inner guide tube 36 so as to hold the lock housing 44, the elevation adjustment tube 32 surrounded by lock housing 44, and the adjustable chair arm 20 coupled thereto in place. The spring receiving pin 74 of lock 70 that is axially aligned with and lies opposite the detent pin 72 is positioned inwardly of the lock exit port 57 in the elevation adjustment stop 52 and the spring pin opening 50 (also of FIG. 7) in the side 44-2 of lock housing 44.

In order to change the elevation of the adjustable arm 20, a pushing force is applied to the detent actuator 28. A depression of actuator 28 causes the actuator head 60 of actuator arm 62 connected thereto to simultaneously move downwardly through the hollow elevation adjustment tube 32 towards the sides 44-1 and 44-2 (shown in FIG. 7) of lock housing 44, whereby the coiled compression spring 66 is compressed between the actuator head 60 and the lock housing 44 so as to store energy. Because the ramped fork 64 at the bottom of actuator arm 62 is seated on the detent pin 72 of lock 70, a linear displacement of the actuator arm downwardly through elevation adjustment tube 32 is translated into a lateral displacement of the lock 70 through the side 44-2 of lock housing 44.

More particularly, the ramped fork 64 is responsive to the depression of detent actuator 28 and the downward movement of actuator arm 62 so as to impart a corresponding pushing force against the lock 70 (in the direction of the reference arrow located below the lock). Accordingly, the detent pin 72 of lock 70 will now be withdrawn from its original detent hole 40 in the inner guide tube 36 and pulled inwardly towards the detent opening 51 (of FIG. 7) in lock housing side 44-2. At the same time, the spring receiving pin 74 of lock 70 is pushed outwardly through the lock pin opening 50 (also of FIG. 7) in lock housing side 44-2 and the lock exit port 57 in elevation adjustment stop 52. The outward movement of spring receiving pin 74 causes the coiled spring 76 located therearound to be compressed and store energy, as previously described.

With the detent pin 72 of lock 70 withdrawn from the detent hole 40, the user may apply a pushing force against one of the upper or lower arm members 22 and 24 of the adjustable arm 20 to drive the elevation adjustment tube 32 and the lock housing 44 located therearound downwardly through the inner guide tube 36 to lower the elevation of arm 20. Of course, the user may also exert a pulling force against the arm members 22 and 24 to pull the elevation adjustment tube 32 upwardly and thereby raise the elevation of arm 20.

When the new elevation of the adjustable chair arm 20 has been selected, the user releases the detent actuator 28. The compression spring 66 will now expand and release its stored energy to automatically push the actuator head 60 as well as the actuator arm 62 and the detent actuator 28 back to their original at-rest position, as shown in FIG. 8. In this same regard, the spring 76 surrounding the spring receiving pin 74 of lock 70 also expands to release its stored energy, whereby to force the lock 70 to move laterally through the lock housing 44 such that detent pin 72 is pushed outwardly relative to the detent pin opening 51 in lock housing 44 for receipt by a different one of the detent holes 40 formed in the inner guide tube 36. The adjustable chair arm 20 is once again locked in place at the elevation selected by the user until the detent actuator 28 is depressed later on to make a new adjustment.

The invention claimed is:

1. An adjustable arm assembly for a chair having a seat, a back rest, and a frame by which said adjustable arm assembly is positionable relative to the seat and back rest, said adjustable arm assembly comprising:

an adjustable arm;

a lock actuator to be operated in order to permit said adjustable arm to be changed from one elevation to another;

an elevation adjustment member interconnected to said adjustable arm;

a hollow elevation adjustment guide in which to slidably receive said elevation adjustment member;

a lock communicating with said lock actuator, said lock engaging said hollow elevation adjustment guide when said lock actuator is not being operated to releasably retain said elevation adjustment member within said adjustment guide, whereby to prevent an elevation change of said adjustable arm, and said lock moving out of engagement with said elevation adjustment guide in response to the operation of said lock actuator to permit said elevation adjustment member to slide through said elevation adjustment guide so that the elevation of said adjustable arm interconnected to said elevation adjustment member can be correspondingly changed;

a lock housing carried by said elevation adjustment member and slidable therewith through said hollow elevation adjustment guide, said lock sliding through said lock housing from a locked position at which said lock is moved into engagement with said elevation adjustment guide to an unlocked position at which said lock is moved out of engagement with said elevation adjustment guide;

an elongated actuator arm extending between said lock actuator and said lock by which to enable said lock to communicate with said lock actuator, the operation of said lock actuator causing said elongated actuator arm to move longitudinally through said elevation adjustment member to cause said lock to slide in said lock housing to said unlocked position; and a first spring surrounding said elongated actuator arm within said elevation adjustment member, said first spring being compressed and storing energy when said lock actuator is operated and said actuator arm moves longitudinally through said elevation adjustment member towards said lock housing, and said first spring expanding and releasing its stored energy to force said actuator arm to move away from said lock housing when said lock actuator is no longer operated.

2. The adjustable arm assembly recited in claim 1, further comprising an outer arm assembly cover spaced from and surrounding said hollow elevation adjustment guide in which said elevation adjustment member is slidably received, said outer arm assembly cover having an opening through which the frame of the chair can be connected to said elevation adjustment guide.

3. The adjustable arm assembly recited in claim 1, wherein said elongated actuator arm includes a ramped fork at one end thereof, said ramped fork seated upon said lock, whereby the longitudinal movement of said actuator arm is translated into a lateral movement of said lock in said lock housing between said locked and unlocked positions.

4. The adjustable arm assembly recited in claim 1, further comprising a plurality of detent holes formed in said hollow elevation adjustment guide, said lock having a detent for receipt through one of said plurality of detent holes when said lock actuator is not being operated and said lock is in said locked position so as to releasably retain said elevation adjustment member within said elevation adjustment guide and thereby prevent an elevation change of said adjustable arm.

5. The adjustable arm assembly recited in claim 4, wherein said lock housing has a detent opening formed therein, said lock detent being received through each of the detent opening of said lock housing and the one of said plurality of detent holes of said hollow elevation adjustment guide when said detent actuator is not being operated and said lock is in said locked position.

6. The adjustable arm assembly recited in claim 5, wherein said lock also has a spring receiving pin located opposite said detent thereof, and said lock housing has a spring pin opening for receipt of said spring receiving pin.

7. The adjustable arm assembly recited in claim 6, further comprising a second spring surrounding the spring receiving pin of said lock within said lock housing, said second spring exerting a pushing force against said lock when said lock actuator is not being operated to urge said lock to said locked position so that said lock detent is received through each of the detent opening of said lock housing and the one of said plurality of detent holes of said hollow elevation adjustment guide.

8. The adjustable arm assembly recited in claim 7, wherein an operation of said lock actuator causes said lock to slide in said lock housing from said locked position to said unlocked position and said second spring surrounding the spring receiving pin of said lock to be compressed to store energy, whereby said lock detent is pulled out of its receipt by the one of said plurality of detent holes of said hollow elevation adjustment guide and the spring receiving pin of said lock is pushed outwardly through the spring pin opening of said lock housing.

9. The adjustable arm assembly recited in claim 1, further comprising an elevation adjustment stop carried by said lock housing and slidable therewith as said elevation adjustment member slides through said hollow elevation adjustment guide, said elevation adjustment stop limiting the sliding movement of said elevation adjustment member through said elevation adjustment guide to correspondingly control the elevation to which said adjustable arm can be changed.

10. The adjustable arm assembly recited in claim 9, wherein said elevation adjustment stop has a key projecting therefrom and said lock housing has a keyhole formed therein, said key received within said keyhole by which said elevation adjustment stop is attached to and carried by said lock housing.

11. The adjustable arm assembly recited in claim 9, wherein said hollow elevation adjustment guide has an elevation adjustment slot formed therein, said elevation adjustment stop being received in and riding through said elevation adjustment slot so as to limit the sliding movement of said elevation adjustment member through said elevation adjustment guide depending upon the dimensions of said slot.

12. An adjustable arm assembly for a chair having a seat and a back rest, said adjustable arm assembly comprising:

an adjustable arm;

a lock actuator to be operated in order to permit said adjustable arm to be changed from one elevation to another relative to the seat of said chair;

an elevation adjustment member interconnected to said adjustable arm;

a hollow elevation adjustment guide in which to slidably receive said elevation adjustment member, said elevation adjustment guide having a plurality of holes formed therein, each hole corresponding to a different elevation relative to the seat of said chair;

a lock carried by said elevation adjustment member and communicating with said lock actuator, said lock having a locking pin received through one of said plurality of holes in said elevation adjustment guide when said lock actuator is not being operated so as to releasably retain and thereby prevent a relocation of said elevation adjustment member within said elevation adjustment guide, said locking pin being withdrawn from said hole in said elevation adjustment guide in response to the operation of said lock actuator to permit said elevation adjustment member to slide through said elevation adjustment guide so that the elevation of said adjustable arm interconnected to said elevation adjustment member can be correspondingly changed; and an actuator arm extending between said lock actuator and said lock by which to enable said lock to communicate with said lock actuator, the operation of said lock actuator causing said actuator arm to move towards said lock to cause said locking pin thereof to be withdrawn from the one of said plurality of holes formed in said hollow elevation adjustment guide to permit said elevation adjustment member to slide through said elevation adjustment guide, said actuator arm including a ramped fork located at one end thereof and coupled to said lock such that the movement of said actuator arm towards said lock in response to the operation of said lock actuator causes said locking pin to be withdrawn from the one of said plurality of holes formed in said hollow elevation adjustment guide.

13. The adjustable arm assembly recited in claim 12, wherein said elevation adjustment member is a hollow tube, said actuator arm being surrounded by and moving longitudinally through said hollow tube towards said lock in response to the operation of said lock actuator to cause a corresponding lateral displacement of said lock relative to said hollow tube, whereby said locking pin is withdrawn from the one of said plurality of holes formed in said hollow elevation adjustment guide.

14. The adjustable arm assembly recited in claim 12, further comprising an elevation adjustment stop coupled to said lock and slidable with said lock and said elevation adjustment member through said hollow elevation adjustment guide, said elevation adjustment guide having a slot formed therein, and said elevation adjustment stop being received in and riding through the elevation adjustment slot formed in said elevation adjustment guide so as to limit the sliding movement of said lock and said elevation adjustment member through said elevation adjustment guide to correspondingly control the elevation to which said adjustable arm can be changed depending upon the dimensions of said elevation adjustment slot.

15. An adjustable arm assembly for a chair having a seat and a back rest, said adjustable arm assembly comprising:

an adjustable arm;

a lock actuator to be operated in order to permit said adjustable arm to be changed from one elevation to another relative to the seat of said chair;

an elevation adjustment member interconnected to said adjustable arm;

a hollow elevation adjustment guide in which to slidably receive said elevation adjustment member;

a lock communicating with said lock actuator, said lock engaging said hollow elevation adjustment guide when said lock actuator is not being operated to releasably retain said elevation adjustment member within said adjustment guide, whereby to prevent an elevation change of said adjustable arm, and said lock moving out of engagement with said elevation adjustment guide in response to the operation of said lock actuator to permit said elevation adjustment member to slide through said elevation adjustment guide so that the elevation of said adjustable arm interconnected to said elevation adjustment member can be correspondingly changed;

a lock housing carried by said elevation adjustment member and slidable therewith through said hollow elevation adjustment guide, said lock sliding through said lock housing in response to the operation of said lock actuator from a locked position at which said lock is moved into engagement with said elevation adjustment guide to an unlocked position at which said lock is moved out of engagement with said elevation adjustment guide; and an elevation adjustment stop carried by said lock housing and slidable therewith as said elevation adjustment member slides through said hollow elevation adjustment guide, said elevation adjustment stop limiting the sliding movement of said elevation adjustment member through said elevation adjustment guide to correspondingly control the elevation to which said adjustable arm can be changed.

16. The adjustable arm assembly recited in claim 15, wherein said elevation adjustment stop has a key projecting therefrom and said lock housing has a keyhole formed therein, said key received within said keyhole by which said elevation adjustment stop is attached to and carried by said lock housing.

17. The adjustable arm assembly recited in claim 15, wherein said hollow elevation adjustment guide has an elevation adjustment slot formed therein, said elevation adjustment stop being received in and riding through said elevation adjustment slot so as to limit the sliding movement of said elevation adjustment member through said elevation adjustment guide depending upon the dimensions of said elevation adjustment slot.

* * * * *